US006978756B2

(12) United States Patent
Korenjak et al.

(10) Patent No.: US 6,978,756 B2
(45) Date of Patent: Dec. 27, 2005

(54) LUBRICATION SYSTEM FOR A POWER PLANT

(75) Inventors: Norbert Korenjak, Stadl-Paura (AT); Stefan Leiber, Marchtrenk (AT)

(73) Assignee: BRP-Rotax GmbH & Co. KG, Gunskirchen (AT)

( * ) Notice: Subject to any disclaimer, the term of this patent is extended or adjusted under 35 U.S.C. 154(b) by 0 days.

(21) Appl. No.: 10/662,876

(22) Filed: Sep. 16, 2003

(65) Prior Publication Data

US 2004/0134459 A1 Jul. 15, 2004

Related U.S. Application Data

(60) Provisional application No. 60/410,796, filed on Sep. 16, 2002.

(51) Int. Cl.[7] ..... F02F 7/00; F01M 1/00
(52) U.S. Cl. ..... 123/196 R; 123/195 R
(58) Field of Search ..... 123/196 R, 195 R, 123/196 M, 90.33, 572

(56) References Cited

U.S. PATENT DOCUMENTS

| | | | |
|---|---|---|---|
| 6,257,192 | B1 | 7/2001 | Yamaura et al. |
| 6,314,934 | B1 | 11/2001 | Ito et al. |
| 6,332,444 | B1 | 12/2001 | Narita et al. |
| 6,343,584 | B1 * | 2/2002 | Kudou et al. ..... 123/196 R |
| 6,443,263 | B1 | 9/2002 | Ito et al. |
| 6,457,564 | B1 | 10/2002 | Damm et al. |
| 6,497,211 | B2 | 12/2002 | Nomura et al. |
| 2002/0043237 | A1 | 4/2002 | Nomura et al. |

FOREIGN PATENT DOCUMENTS

| | | |
|---|---|---|
| DE | 37 31 597 A1 | 4/1988 |
| DE | 4140667 A1 | 6/1993 |
| DE | 4304743 | 8/1994 |
| EP | 0 119 135 A1 | 9/1984 |
| EP | 1 217 182 A1 | 6/2002 |
| JP | 61-182407 | 8/1986 |
| JP | 8-135419 | 5/1996 |

OTHER PUBLICATIONS

European Search Report dated Mar. 14, 2005, for European Patent Application No. 04022047.7, which is the counterpart of the U.S. application captioned above.

* cited by examiner

*Primary Examiner*—Henry C. Yuen
*Assistant Examiner*—Hyder Ali
(74) *Attorney, Agent, or Firm*—BRP Legal Services

(57) ABSTRACT

A power unit is described that combines an internal combustion engine and a lubrication system. The internal combustion engine includes a crankcase suction chamber and a transmission case suction chamber. At least one partition separates the crankcase suction chamber from the transmission case suction chamber. The lubrication system supplies lubricant to the internal combustion engine. The lubrication system includes a lubrication tank and a supply line for supplying lubricant to the internal combustion engine. At least one crankcase drainage line extends from the crankcase to drain a fluid from the crankcase suction chamber and transfer the fluid to the transmission case suction chamber. At least one pump operatively connects to one of either the crankcase chamber or the transmission case chamber. By the operation of the at least one pump, a negative pressure within at least one of the crankcase chamber and the transmission case chamber is created.

51 Claims, 4 Drawing Sheets

LUBRICATION SYSTEM FOR A POWER PLANT

CROSS-REFERENCE TO RELATED APPLICATIONS

This application claims priority to U.S. Provisional Patent Application Ser. No. 60/410,796, entitled "Lubrication System," filed on Sep. 16, 2002, the disclosure of which is specifically incorporated herein by reference.

FIELD OF THE INVENTION

The present invention relates to a dry sump lubrication system for a power plant having an internal combustion engine and a gearbox for use in numerous vehicles including but not limited to snowmobiles, personal watercraft, motorcycles, three-wheeled vehicles, go-karts, all terrain vehicles, scooters and the like. In particular, the present invention relates to a lubrication system for a power plant in which negative pressure is created in the crankcase and other compartments or areas of the engine to remove lubricant and blow-by gases in a well defined manner. The dry sump lubrication system in accordance with the present invention may be used in either a two cycle engine or a four cycle engine. Furthermore, the lubrication system in accordance with the present invention may be used in an engine having one, two or more cylinders. The cylinders may be arranged in line or in a V-type arrangement.

BACKGROUND OF THE INVENTION

Typically, power plants include either a wet sump lubrication system or dry sump lubrication system.

In a wet sump lubrication system, oil is collected in an oil pan at the bottom of the crankcase after lubricating various engine components. The oil is then pumped directly from the oil pan to diverse locations requiring lubrication by means of an oil pump.

In a dry sump lubrication system, lubricant is removed or sucked from the crankcase before being recirculated to the power plant. Dry sump lubrication systems typically require less volumes of lubricant when compared to wet sump lubrication systems. In dry sump lubrication systems, blow-by gases may be used for conveying oil from the oil sump in the crankcase into an oil reservoir by way of an intake or riser line.

In dry sump lubrication systems, those skilled in the art recognize that it is desirable to maintain a negative pressure (or vacuum) within the crankcase. Other chambers connected to the crankcase, however, are not maintained under a negative pressure (or vacuum), because those skilled in the art do not perceive a benefit to such a construction.

German Patent No. DE 37 31 597 A1 describes one example of a dry sump lubrication system that relies on a controlled vacuum generator to ensure a vacuum in the crank chamber of an internal combustion engine. The controlled vacuum generator is assigned to a breather line emerging from the oil reservoir and opening into the intake pipe of the engine. The vacuum generator is connected by way of a signal line to a vacuum sensor in the crank chamber. The generator prevents leakage of gases and steam from the engine. The blow-by gases are forced from the combustion chamber of the engine into the crankcase during combustion. These blow-by gases must be dissipated or discharged to avoid a positive buildup of pressure within the engine.

European Patent No. EP 119135 A1 describes another example of a dry sump lubrication system. In this patent, a vacuum pump communicates with the crankcase. While the vacuum pump is in operation, blow-by gas in the crankcase is drained to the outside environment, whereby a negative pressure is created in the crankcase. The vacuum pump is provided to drain only the crankcase.

One drawback of the system described in this European patent lies in the fact that air may remain present in the crankcase during operation of the engine. During operation, the piston reciprocates within the cylinder, thereby performing the respective steps of intake, compression, combustion, and exhaust. When the engine is running, movement of the piston during intake (suction) and combustion (explosion) and the rotational motion of the connecting rod and the crankshaft are disturbed by the air in the crankcase, which reduces engine output. Furthermore, the air in the crankcase deteriorates the quality of the operation of the engine, because it may cause the lubricant to oxidize or deteriorate, which reduces the quality of the lubricant.

There have been numerous attempts to separate the crank chamber from other engine chambers, but none disclose maintaining two or more of these chambers under negative pressure. As indicated above, those skilled in the art do not recognize the benefit of such a construction.

For example, Japanese Patent Publication No. 61-182407 discloses the separation of a crank chamber and a transmission chamber. The chambers are connected via a reed valve. It is noted, however, that the transmission chamber is not held under negative pressure.

Similarly, Japanese Patent Publication No. 8-135419 discloses the separation of a crank chamber and the transmission chamber. The chambers are connected via an oil pump. As with the previous reference, the transmission chamber is not held under negative pressure.

Two other examples, U.S. Pat. Nos. 6,257,192 and 6,497,211, both disclose a crank chamber being separated from the transmission chamber. As with the Japanese examples, the transmission chamber is not held under negative pressure.

U.S. Pat. No. 6,497,211 discloses yet another arrangement. Here, a separate lubrication circuit is provided for each chamber. The different chambers are not held under negative pressure.

EP Patent Publication No. 1217182 discloses one further arrangement. Here, only the crank chamber held under negative pressure. The crankcase is separated from the transmission case. An oil pump drains oil from the crankcase and pumps the oil to the transmission case. From the transmission case, the oil flows into the lubrication tank, which is positioned below the transmission case. This arrangement is necessary because the transmission case cannot be positioned below the oil level in the lubrication tank. Otherwise, the oil would aggregate in the transmission case, which would be at the lowest position in the lubrication system.

One problem that is presented by the prior art lies in the fact that those skilled in the art have focused on separating the crankcase from the other chambers associated with the engine. As such, the prior art does not recognize the benefits of the present invention.

BRIEF SUMMARY OF THE INVENTION

It is, therefore, an aspect of embodiments of the present invention to provide a construction for an engine which provides improved drainage of lubrication and blow-by gases from the various engine chambers.

It is another aspect of embodiments of the present invention to provide a lubrication system for an engine, where the locations of various of the chambers associated with the engine are not limited by the oil level within the oil or lubrication tank.

In particular, it is an aspect of the present invention to keep one or more of the chambers associated with the engine under a negative pressure or under a vacuum. For this reason, among others, it is possible to arrange the various chambers around the crankcase without regard to the oil level in the lubrication or oil tank.

It is at least one aspect of the present invention to provide a power unit having an internal combustion engine, a transmission and a lubrication system. The internal combustion engine includes a crankcase defining a chamber therein, a crankcase suction port fluidly connected to the crankcase chamber, and at least one cylinder associated with the crankcase. The internal combustion engine may be either a 2-cycle or a 4-cycle internal combustion engine. The transmission includes a transmission case defining a chamber therein, distinct from the crankcase chamber and in fluid communication therewith, and a transmission case suction port fluidly connected to the transmission case chamber. The lubrication system supplies lubricant to at least one of the internal combustion engine and the transmission. The lubrication system may be either a dry sump or a wet sump lubrication system. The lubrication system includes a lubrication tank, at least one lubricant supply for supplying lubricant from the lubrication tank to at least one of the crankcase chamber and the transmission chamber, at least one lubricant return for returning lubricant to the lubrication tank, and at least one pump in fluid communication with the suction port of the transmission case, whereby operation of the at least one pump withdraws lubricant from the transmission case chamber.

In accordance with another aspect of the present invention, the power unit further includes an additional unit comprising an additional unit case defining an additional unit case chamber therein, distinct from the crankcase chamber and the second unit case chamber and in fluid communication therewith, an additional unit suction port fluidly connected to the additional unit case chamber; and an additional pump having an inlet in fluid communication with one of the crankcase suction port and the additional unit suction port and an outlet in fluid communication the lubricant return, whereby operation of the additional pump withdraws lubricant from the one of the crankcase suction port and the additional unit suction port and returns lubricant to the lubrication tank. The additional unit may comprise one of a clutch for coupling and decoupling the internal combustion engine to a device for driving a vehicle, and a valve system for operating intake and exhaust valves of the internal combustion engine It is at least one aspect of the present invention to provide a power unit comprising an internal combustion engine, a second unit and a lubrication system. The internal combustion engine includes a crankcase defining a chamber therein, a crankcase suction port fluidly connected to the crankcase chamber, and at least one cylinder associated with the crankcase. The second unit includes a second unit case defining a second unit case chamber therein, distinct from the crankcase chamber and in fluid communication therewith, a second unit suction port fluidly connected to the second unit case chamber. The lubrication system provides an oil supply for use in the internal combustion engine and the second unit. The lubrication system includes a lubrication tank, a lubricant supply for supplying lubricant from the lubrication tank to at least one of the crankcase chamber and the second unit case chamber, at least one lubricant return for returning lubricant to the lubrication tank, and a first pump having an inlet in fluid communication with the second unit suction port and an outlet in fluid communication the lubricant return, whereby operation of the pump withdraws lubricant from the second unit suction port and returns lubricant to the lubrication tank.

A second pump may be provided having an inlet in fluid communication with the crankcase suction port and an outlet in fluid communication the lubricant return. The operation of the second pump withdraws lubricant from the crankcase suction port and returns lubricant to the lubrication tank.

The crankcase chamber may be connected to the second unit case chamber. The lubricant in the crankcase chamber may withdrawn via the second unit case chamber.

The power unit may further include a power unit case, wherein the power unit case forms at least a portion of the crankcase and the second unit case, wherein the portion of the crankcase is integrally formed with the portion of the second unit case. A second pump may be provided having an inlet in fluid communication with the crankcase suction port and an outlet in fluid communication the lubricant return, whereby operation of the second pump withdraws lubricant from the crankcase suction port and returns lubricant to the lubrication tank.

The second unit may include one of a transmission for transmitting power from the internal combustion engine to a device for driving a vehicle, a clutch for coupling and decoupling the internal combustion engine to a device for driving a vehicle, and a valve system for operating intake and exhaust valves of the internal combustion engine.

An additional aspect of the present invention provides a power unit where the lubrication system is preferably a dry sump lubrication system. The negative pressure permits lubricant to be drained more efficiently from different engine areas such as the crankcase, the gearbox housing, and other engine casing parts by creating a negative pressure within each of the different engine areas. This arrangement improves engine efficiency and lubricant quality by providing better degassing of the lubricant. The present invention further reduces the oil tank volume.

In accordance with the present invention, the at least one drainage line may include a plurality of drainage lines, which extend to the lubrication tank, the gearbox and additional compartments within the power plant that are also partitioned or isolated from the gearbox and the crank chamber. A first drainage line may extend from the crank chamber, wherein the first drainage line is operatively connected to the lubrication tank to drain blow-by gas and lubricant from the crank chamber. A second drainage line extend from the crank chamber to the gear box to supply blow-by gas to the gearbox. It is possible to also drain lubricant from the crank chamber to the gearbox. The second drainage line may be operatively connected to a secondary air supply. The secondary air supply increases the amount of air supplied to the gearbox to improve scavenging within the gearbox.

The present invention is not intended to be limited to supplying blow-by gas to just the gearbox to improve the drainage of lubricant therefrom. Blow-by gas can be supplied from the crank chamber to other engine compartments. The blow-by gas can be supplied in parallel such that it is separately fed into the gearbox and the additional compartments or the gas can be supplied in series such that it is from one compartment into the next. The crank chamber, the gear box and the additional compartments can be separately drained by drainage lines that extend from each compartment or they can be drained in series whereby lubricant and blow-by gas is first drained from the crank chamber into the gearbox or adjacent compartment and then into subsequent compartments. In either case, at least one suction pump is provided to create a negative pressure to improve the flow of lubricant and blow-by gas. Due to the improved drainage of lubricant from the engine cases and chambers, the total oil quantity can be used more efficiently, and, consequently, the oil tank volume can be reduced and engine volume reduced.

The present invention is also directed to a method of recirculating lubrication in a power plant. The method includes supplying lubricant from the lubrication tank to the crank chamber and the gearbox. The lubricant is drained from the crank chamber and the gearbox under the influence of a negative pressure. The lubricant is then returned to the lubrication tank. Blow-by gas is transferred from the crank chamber to the gearbox to improve drainage of lubricant from the gearbox.

BRIEF DESCRIPTION OF THE DRAWINGS

The present invention will be described in conjunction with the following figures in which like reference numerals designate like components and wherein.

DETAILED DESCRIPTION OF THE PREFERRED EMBODIMENTS

Figure 1:
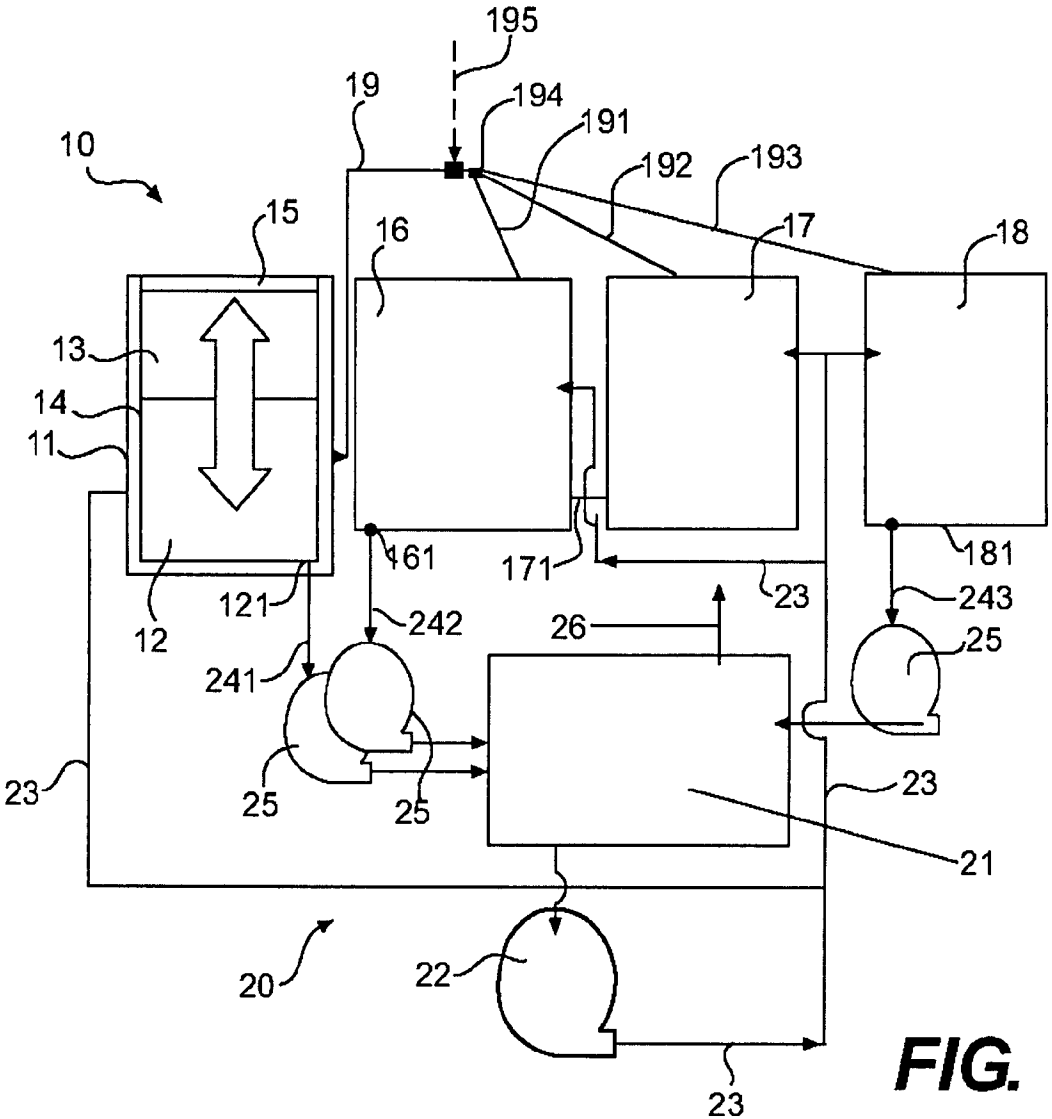
FIG. 1 is a schematic diagram of a lubrication system using negative pressure in separate engine compartments to improve lubricant drainage in accordance with one embodiment of the present invention.

A dry sump lubrication system in accordance with one embodiment of the present invention will now be described in greater detail in connection with FIG. 1. An internal combustion engine and a gearbox are combined to form a power plant or common drive unit 10 having a common dry sump lubrication circuit 20. The drive unit 10 includes a crankcase 11 having crank chamber 12 formed therein. The crank chamber 12 houses the crankshaft (not shown) and the piston arm (not shown), which are operatively connected to a piston 13.

The crankcase 11 includes at least one cylinder 14. However, the present invention is not limited to power plants 10 with only one cylinder 14. The crankcase 11 may include one, two or more cylinders 14. The cylinders may have either an in-line arrangement or a V-type arrangement. A piston 13 is located within each cylinder 14. The piston 13 is slidably disposed in the cylinder 14 and, by its operation, defines a combustion chamber 15 therein.

The drive unit 10 further includes a clutch chamber 16, a valve chamber 17 and a gearbox 18. The gearbox 18 also is referred to as a transmission case or transmission chamber herein. The terms are meant to be interchangeable for purposes of this discussion. Furthermore, while the description that follows focuses on specific chambers (or spaces) 16, 17, 18 associated therewith, the present invention is not limited solely thereto. Additional engine chambers or spaces may be provided for ignition components and other power plant components, for example.

During combustion, gases are created in the combustion chamber 15. Certain blow-by gases are pressed from the combustion chamber 15 between the cylinder wall and the piston 13 into the crank chamber 12. The blow-by gases are discharged from the crank chamber 12 through at least one gas conduit or line 19. The at least one gas conduit 19 may include connecting conducts 191, 192, 193 for operatively connecting the at least one conduct 19 to at least one of the clutch chamber 16, the valve chamber 17 and the gearbox 18 (or transmission case) or any of the additional engine chambers. A secondary supply of air may be provided by including at least one air restrictor 194 connected to an air supply line 195 or other air source (including the atmosphere). The air restrictor 194 permits outside air to be drawn into the gas conduit 19, such that the air is subsequently fed into at least one of the clutch chamber 16, the valve chamber 17, the gearbox 18 or any of the additional engine chambers.

Supplying blow-by gases from the crank chamber 12 and secondary air to the chambers 16, 17 and 18 improves the drainage of lubricant from the suction chambers within the chambers 16, 17 and 18 by improving the flow pattern inside these chambers. As a result, the chambers are scavenged more efficiently. The scavenging air flow and blow-by gas flow supports the drainage flow of the lubricant through the suction ports 161 and 181. The discharge of the blow-by gases from the crank chamber 12 into the other chambers 16, 17, and 18 produces a scavenging effect which supports the drainage of the lubricant/blow-by gas mixture in the various drive unit chambers.

It should be noted that that the scavenging effect within the various chambers 16, 17 and 18 associated with the drive unit 10 is believed to apply both to blow-by gases and lubricant therein. However, as may be appreciated by those skilled in the art, scavenging may apply only to blow-by gases or to lubricant. In either case, both the blow-by gases and the lubricant (such as oil) are fluids. It is intended therefore, that the discussion of the scavenged fluid encompasses lubricant alone, blow-by gases alone, or, preferably, a combination of the two.

The dry sump lubrication circuit 20 includes a lubrication tank 21. A pump 22 is operatively connected to the tank 21 to pump lubricant from the tank 21 to various locations within the common drive unit 10 through lubricant conduits or lines 23, which may be integrated into the drive unit 10. Lubricant is fed through the conduits 23 into the crank chamber 12, the clutch chamber 16, the valve chamber 17, the gearbox 18 or any other engine components which require lubrication. For example, the engine components that may require lubrication include the pistons 13, crankshaft, crank arm, bearing(s) and other engine components.

Figure 2:
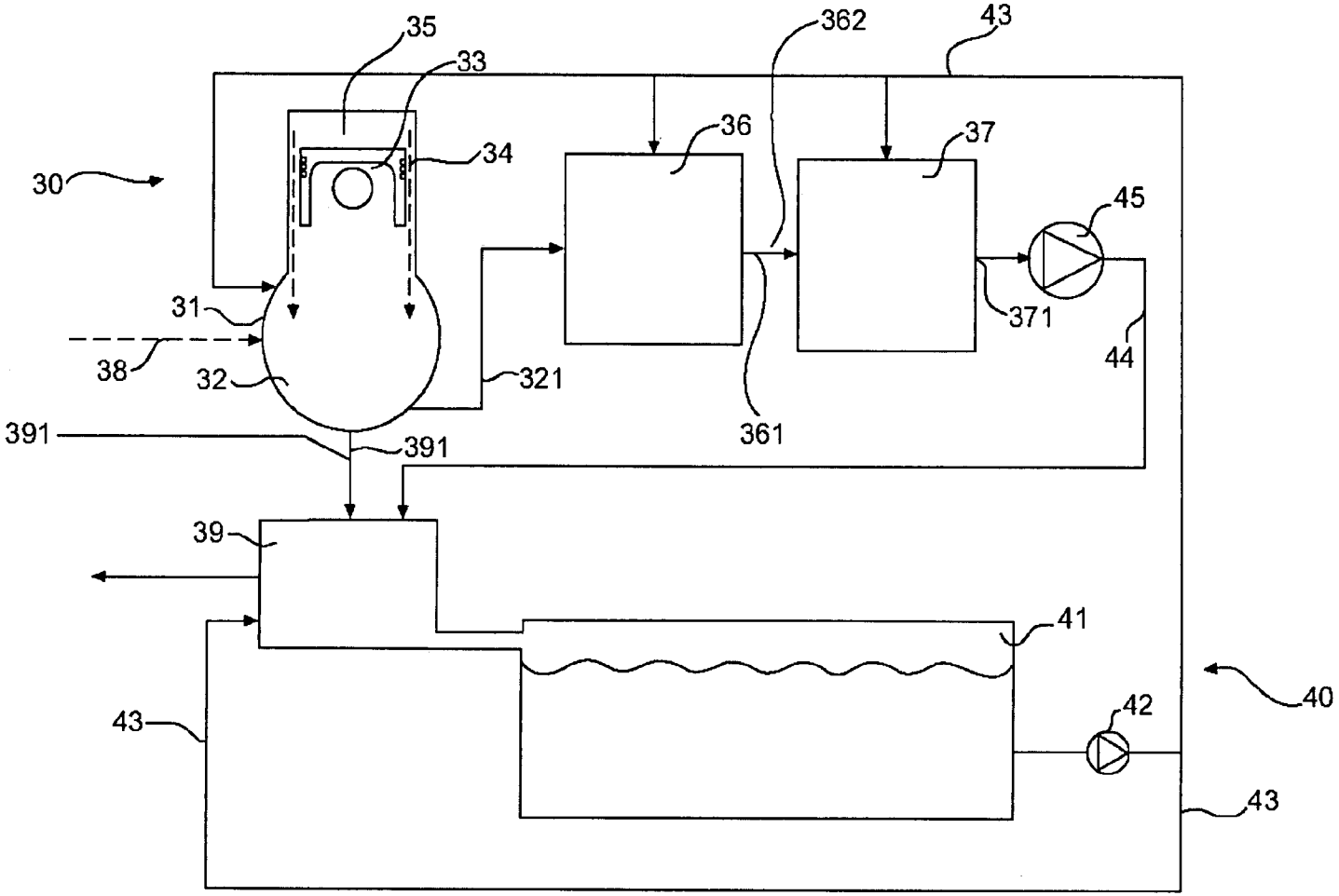
FIG. 2 is a schematic diagram of a lubrication system using negative pressure in separate engine compartments to improve lubricant drainage according to another embodiment of the present invention.
Figure 3:
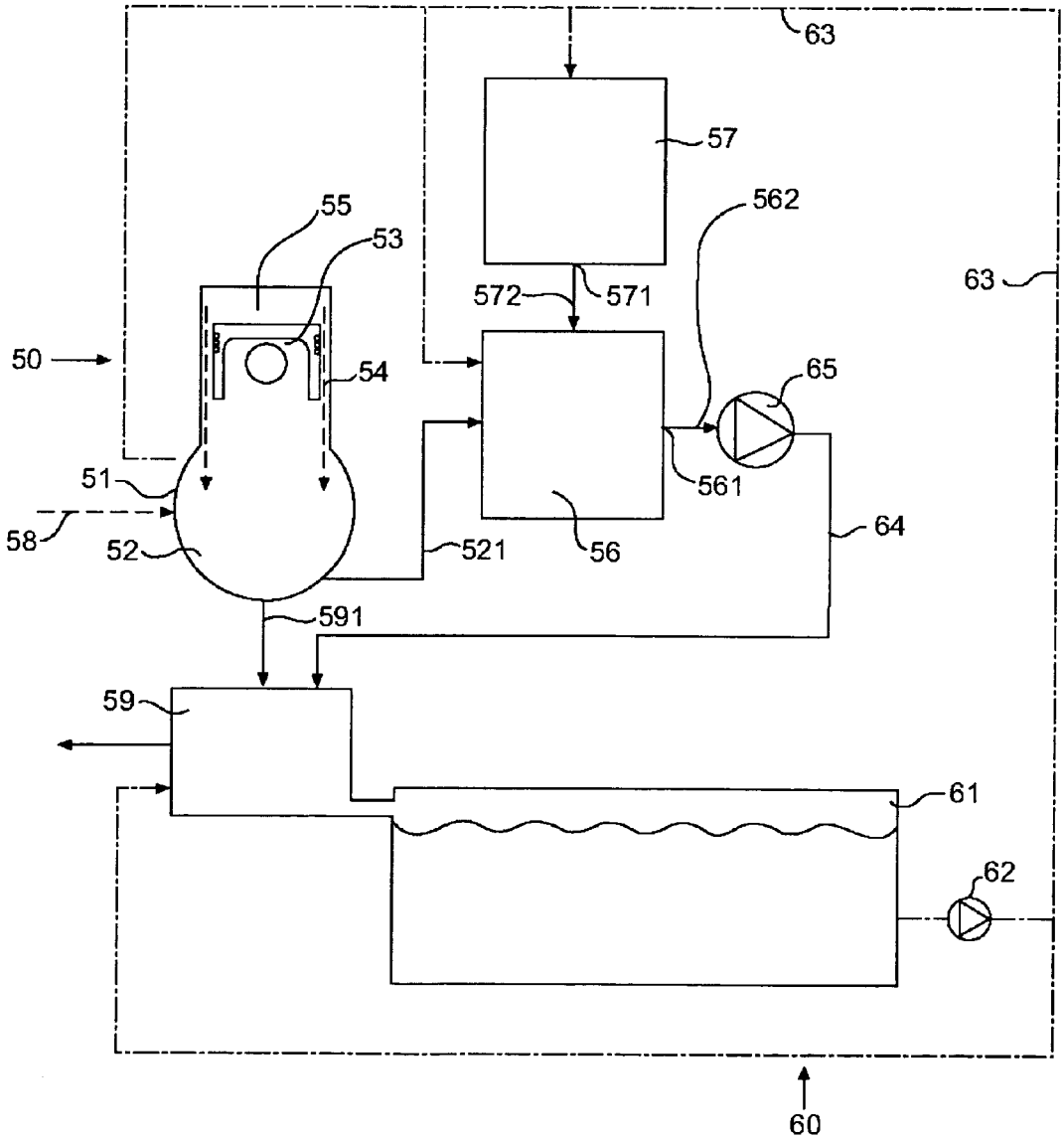
FIG. 3 is a schematic diagram of a lubrication system using negative pressure in separate engine compartments to improve lubricant drainage according to yet another embodiment of the present invention.

The dry sump lubrication circuit 20 includes a plurality of suction ports 121, 161 and 181, which maybe located in the crank chamber 12, the clutch case 16 or the gearbox 18, as shown in FIG. 1. The suction ports 121, 161 and 181 are provided to drain lubricant, blow-by gas and secondary air from the various chambers. It is contemplated that each of the various drive unit chambers may include a suction port. It is also contemplated that numerous chambers can be linked by a drainage linkage 171, such as, for example, between the clutch chamber 16 and the valve chamber 17, as shown in FIG. 1. Alternatively, as illustrated in FIGS. 2 and 3, a single suction port may be provided to draw the lubricant and blow-by gases from the various chambers associated with the drive unit 10.

The suction ports 121, 161, and 181 are connected to one or more drainage lines or conduits 241, 242 or 243. At least one suction pump 25 is provided to create a negative pressure within the various drive unit compartments 12, 16, 17 and 18 to cause the lubricant, blow-by gases and secondary air to be withdrawn from the chambers through the respective suction ports 121, 161 and 181. The mixture of lubricant and blow-by gases is drawn through the conduits or lines 241, 242 and 243 and ultimately fed into the lubrication tank 21.

In accordance with the present invention, a plurality of suction pumps 25 may be provided such that a separate suction pump corresponds to each drainage line 241, 242 and 243. Alternatively, a split pump may also be employed to provide the necessary suction force. With a split pump, a set of separate pumps are located on and driven by a common pump shaft. The suction pumps 25 create a suction force that generates a negative pressure within the various drive unit chambers. This negative pressure improves drainage of the lubricant and blow-by gases from the suction chambers located in the lower portions of the chambers 16, 17 and 18.

The negative pressure improves the flow pattern because the chambers are scavenged more efficiently. Since the potential discharge rate of the suction pumps 25 is higher than the actual fluid quantity (lubricant+blow-by gas+air) inside the engine, a negative pressure develops inside the suction chambers, within the chambers 12, 16, 17 and 18. This negative pressure, in combination with the low oil level (dry sump) in the cases and chambers, reduces losses due to plunging of the crankshaft in the crank chamber 12 and of the gear wheels in the gearbox. This effect is especially pronounced at higher rotational speeds of the engine, which, consequently, results in an increase in engine performance and in a reduction of fuel consumption. Furthermore, the lubricant quality is improved by degassing the lubricant/gas mixture.

The lubricant and blow-by gases are drained into the lubricant tank 21, which is held under atmospheric pressure. Gravity permits some of the blow-by gases to escape out of the lubricant. The buoyancy force of the gas bubbles causes the gas collect in the upper portion of the lubricant tank 21. It is also conceivable to provide an oil/gas separator (e.g. a cyclone separator) between the suction pump 25 and the oil tank 21 or between the oil tank 21 and the induction system to further clean up the recirculated gas flow.

The separated gases are conveyed through conduct 26 to the engine induction system, not shown, whereby the gas is fed back and burned in the combustion chamber 15. Instead of recirculating the separated gas back to the induction system, the gas also may be used for hydro-pneumatic applications. For example, the gas may be used to operate pneumatic valve springs, a clutch for a motorcycle as is known from Austrian Patent No. AT 403 507 B, or it can be used to operate a working cylinder or the like.

The lubricant in the tank 21, which is now free from gas (or substantially free from gas), is buffered in the oil tank 21 and distributed to the different recipients in the engine, such as, for example, bearings, pistons, gears, clutches and so on, with assistance from the lubricant 22 through conducting 23 pump. Preferably, the lubricant is first passed through an oil filter to be cleaned.

A dry sump lubrication system in accordance with another embodiment of the present invention will now be described in connection with FIG. 2. An internal combustion engine and a gearbox are combined to form a common drive unit 30 having a common dry sump lubrication circuit 40. This embodiment is especially suited for use in a motorcycle or other vehicles where space is at a premium. The drive unit 30 includes a crankcase 31 having crank chamber 32 formed therein. The crank chamber 32 houses the crankshaft (not shown) and the piston arm (not shown), which are operatively connected to a piston 33. The crankcase 31 includes at least one cylinder 34. Each cylinder 34 includes a combustion chamber 35. The drive unit 30 further includes a gearbox 36 and a clutch chamber 37. Additional power plant chambers may be provided for ignition components and other engine components, as would be appreciated by those skilled in the art. In this embodiment, it is preferable that crank chamber 32, the gearbox 36 and the clutch chamber 37 are accommodated within the crankcase 31 to minimize space.

The blow-by gases created in the combustion chamber 35 during combustion and are pressed from the combustion chamber 35 between the cylinder wall and the piston 33 into the crank chamber 32. Typically, this is accomplished by pressing the blow-by gases through conduits formed in the walls of the engine. A secondary supply of air 38 may be provided directly into the crank chamber 32, where it mixes with the blow-by gases. The mixture of blow-by gases and secondary air are discharged from the crank chamber 32 through at least one gas conduit or line 321 into the gearbox 36. The mixture of gases passes through the gearbox 36 into the clutch chamber 37 through conduit or line 362. Supplying the mixture of gases from the crank chamber 32 to the gearbox 36 improves the drainage of lubricant from the suction chambers within the gearbox 36 by improving the flow pattern therein. As a result, the spaces are scavenged more efficiently.

The lubricant and the mixture of gases exits the gearbox 36 through a suction port 361 and is then transferred to the clutch chamber 37 through conduit or line 362. The mixture of gases within the clutch chamber 37 produces the same effect within the clutch chamber 37, whereby the drainage of lubricant is improved. The lubricant collected from the gearbox 36 and the clutch chamber 37 along with the mixture of gases exits the clutch chamber 37 through a suction port 371 where the fluid is then transferred to an ignition cover 39. A by-pass line or conduit 391 maybe provided which operatively connects the crank chamber 32 to the ignition cover 39 such that a portion of the blow-by gas within the crank chamber 32 may be vented directly to the ignition cover 39.

The dry sump lubrication circuit 40 includes a lubrication tank 41, which receives the lubrication and blow-by gases from the ignition cover 39. A pressure pump 42 is operatively connected to the tank 41 to pump lubricant from the tank 41 to various locations within the common drive unit 40 through lubricant conduits or lines 43, which may be integrated into the crankcase 31. Lubricant is fed through the conduits 43 into the crank chamber 32, the gearbox 36, the clutch chamber 37 and the ignition cover 39 to provide lubrication to the various engine components located within these spaces.

As illustrated in FIG. 2, the suction port 371 in the clutch chamber 37 is connected to a drainage line or conduit 44. The drainage line 44 operatively connects the clutch chamber 37 to the ignition cover 39 such that the collected lubricant and the mixture of gases is fed to the ignition cover 39.

A single suction pump 45 is provided to create a negative pressure within the gearbox 36 and the clutch chamber 37 to cause the lubricant, blow-by gases and secondary air to be withdrawn from the chambers 32, 36 and 37 through the suction port 371. In accordance with this embodiment, a single suction pump 45 is provided to minimize the use of space to create a compact construction. As discussed above, the negative pressure created by the suction pump 45 improves drainage of the lubricant and blow-by gases from the suction spaces in the chambers 32, 36, and 37.

The drained lubricant and the mixture of blow-by and secondary gases is fed to the ignition cover 39 and from the cover 39 to the lubricant tank 41. The blow-by and secondary gases are separated in the manner discussed above. These gases are then returned to induction system through conduit 26 whereby the gases are fed into the combustion chamber 35 and subsequently burned.

FIG. 3 illustrates still another embodiment of the invention. As discussed in greater detail below, this embodiment differs from that shown in FIG. 2 in that the gearbox and the clutch chamber are disposed in alternative positions. In addition, the connections between the various components of the system have been rearranged to accommodate the new positions of these components. FIG. 3 illustrates that the exact manner in which the components are arranged is not a critical aspect of the present invention. Instead, as would be appreciated by those skilled in the art, the components may be arranged in any different and varied ways without departing from the scope of the present invention.

A dry sump lubrication system in accordance with another embodiment of the present invention will now be described in connection with FIG. 3. An internal combustion engine and a gearbox are combined to form a common drive unit 50 having a common dry sump lubrication circuit 60. The drive unit 50 includes a crankcase 51 having crank chamber 52 formed therein. The crank chamber 52 houses the crankshaft (not shown) and the piston arm (not shown), which are operatively connected to a piston 53. The crankcase 51 includes at least one cylinder 54. Each cylinder 54 includes a combustion chamber 55. The drive unit 50 further includes a gearbox 56 and a clutch chamber 57. As before, additional power plant chambers may be provided for ignition components and other engine components. As with the previous embodiment, it is preferable that crank chamber 52, the gearbox 56 and the clutch chamber 57 are accommodated within the crankcase 51 to minimize space.

The blow-by gases created in the combustion chamber 55 during combustion and are pressed from the combustion chamber 55 into the crank chamber 52. A secondary supply of air 58 may be provided directly into the crank chamber 52, where it mixes with the blow-by gases. The mixture of blow-by gases and secondary air are discharged from the crank chamber 52 through at least one gas conduit or line 521 into the gearbox 56. The mixture of gases passes through the gearbox 56 into a suction pump 65 through conduit or line 562. Supplying the mixture of gases from the crank chamber 52 to the gearbox 56 improves the drainage of lubricant from the suction spaces within the gearbox 56 by improving the flow pattern therein. As a result, the spaces are scavenged more efficiently. The lubricant and the mixture of gases exits the gearbox 56 through a suction port 561 and is then transferred to an ignition cover 59.

A by-pass line or conduit 591 maybe provided which operatively connects the crank chamber 52 to the ignition cover 59 such that a portion of the blow-by gas within the crank chamber 52 may be vented directly to the ignition cover.

The dry sump lubrication circuit 60 includes a lubrication tank 61. A pressure pump 62 is operatively connected to the tank 61 to pump lubricant from the tank 61 to various locations within the common drive unit 60 through lubricant conduits or lines 63, which may be integrated into the crankcase 61. Lubricant is fed through the conduits 63 into the crank chamber 62, the gearbox 56, the clutch chamber 57 and the ignition cover 59 to provide lubrication to the various engine components located within these spaces.

In this embodiment, lubrication is provided to the clutch chamber 57 via the conduits or line 63. Here, by-pass gases are not channeled thorough the clutch chamber 57. Instead, lubricant exits the clutch chamber 57 via a drainage port 571 and is directed to the gearbox 56 via a conduit 572.

A single suction pump 65 is provided to create a negative pressure within the gearbox 56 and the clutch chamber 57 to cause the lubricant, blow-by gases and secondary air to be withdrawn from the chambers 52, 56 and 57 through the suction port 571. In accordance with this embodiment, a single suction pump 65 is provided to minimize the use of space to create a compact construction. As discussed above, the negative pressure created by the suction pump 65 improves drainage of the lubricant and blow-by gases from the suction spaces in the chambers 52, 56, and 57, to the extent that the spaces receive or are exposed to lubricant, blow-by gases and secondary air.

The drained lubricant and the mixture of blow-by and secondary gases is fed to the ignition cover 59 and from the cover 59 to the lubricant tank 61. The blow-by and secondary gases are separated in the manner discussed above. These gases are then returned to induction system through conduit 26 whereby the gases are fed into the combustion chamber 55 and subsequently burned.

Figure 4:
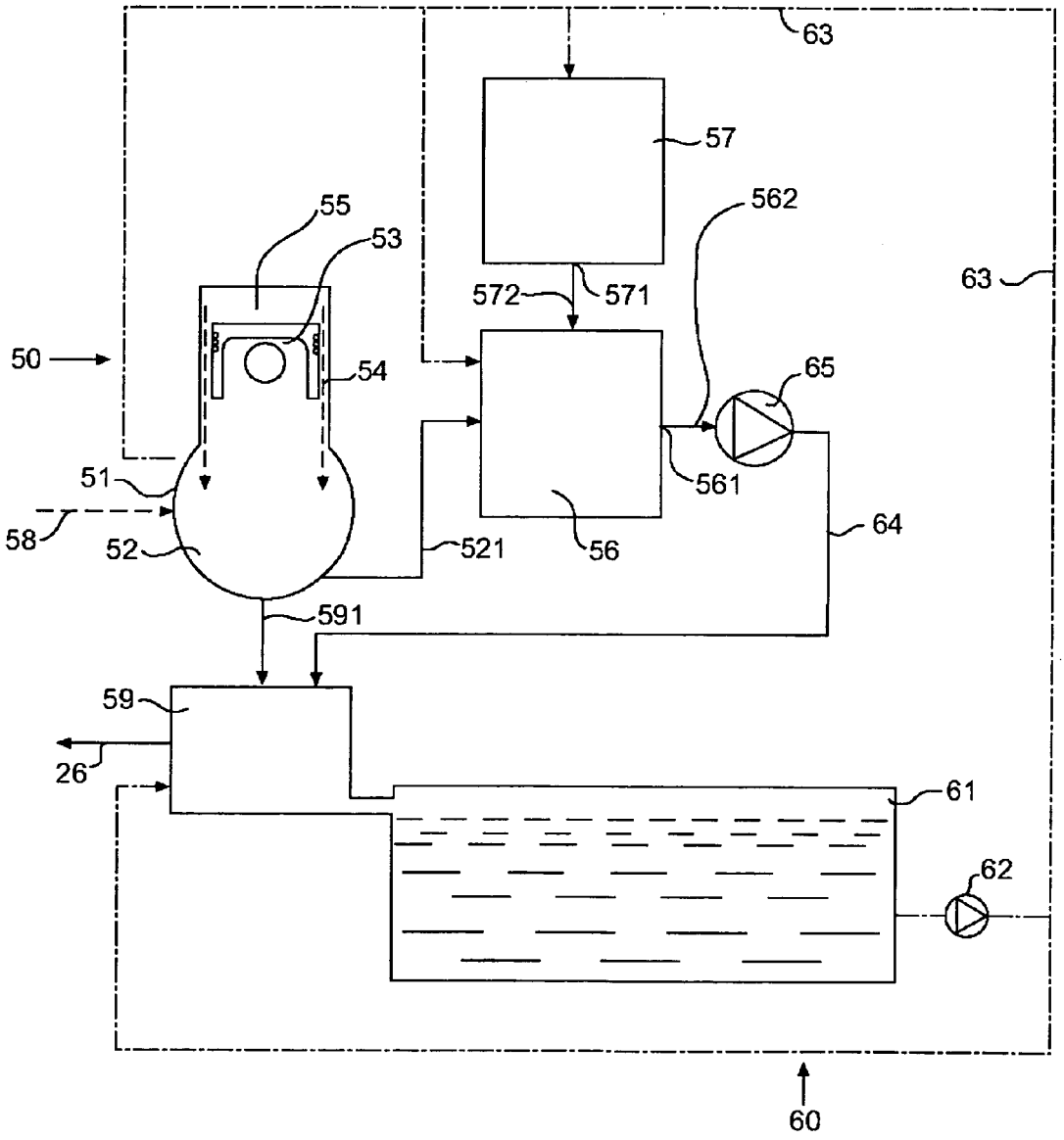
FIG. 4 is a schematic diagram of a lubrication system using negative pressure in separate engine compartments to improve lubricant drainage according to yet another embodiment of the present invention.

A variation of the lubrication system illustrated in FIG. 3 is shown in FIG. 4. In this embodiment, a pump 522 is positioned between the chambers 52 and 56 whereby the pump 522 assists in withdrawing lubricant and blow-by gas from the crank chamber 52 and transferring the same to the gear box 52. It is contemplated that the pump 522 may be included in any one of the embodiments illustrated in FIGS. 1, 2 and 3. Furthermore, a pump may also be provided between chambers 56 and 57 in FIG. 3, chambers 36 and 37 in FIG. 2, and chambers 16 and 17 and/or chambers 17 and 18 in FIG. 1.

While the invention has been described in connection with what is presently considered to be the most practical and preferred embodiments, it is to be understood that the invention is not to be limited to the disclosed embodiments and elements, but, to the contrary, is intended to cover various modifications, combinations of features, equivalent arrangements, and equivalent elements included within the spirit and scope of the appended claims. While an air restrictor 194 has been described in connection with FIG. 1, it is contemplated that at least one air restrictor 194 may be employed in the embodiments shown in FIGS. 2–4. The fluid flow within the suction spaces within the chambers 12, 16, 17, 18, 32, 36, 37, 56 and 57 and the other engine compartments can be optimized in such a way that the drainage effect of the lubricant/gas mixture is maximized. This achieved based upon numerous factors including but not limited to (1) the specific design, location and dimension of the suction ports 121, 161, 181, 361, 371, 561 or 571 for draining the lubricant and/or gas mixture, (2) the specific design of the connecting conduits or lines 19, 321 or 521 for discharging blow-by gas from the crank chamber 12 or 32 to the other chambers 16, 17, 18, 36, 37 and 56, (3) the specific design of the pump characteristics, and (4) secondary air supply from the restrictors 194 to the chambers 16, 17 and 18. The design and tuning primarily depend on the engine's specific overall design and has to be evaluated individually.

It is contemplated that the ignition chamber or cover 39, 59 may house at least one of a starter device, ignition device, at least one balance shaft and/or part of the valve train (e.g. a gear on the crankshaft for driving the timing belt). Accordingly, the ignition cover (chamber) 39, 59 need not be under negative pressure. Additionally, an oil cooler may be provided in conduit 44 and/or 64 to cool the lubricant before entering the lubricant tank 41, 61.

While the present invention has been described in connection with a dry sump lubrication system, it is contemplated that the invention may be used in a wet sump lubrication system as well.

Any dimensions of features of various components that may appear on the drawings are not meant to be limiting, and the size of the components therein can vary from the size that may be portrayed in the figures herein. Thus, it is intended that the present invention covers the modifications and variations of the invention, provided they come within the scope of the appended claims and their equivalents.

What is claimed is:

1. A power unit, comprising:

an internal combustion engine comprising a crankcase defining a chamber therein, a crankcase suction port in fluid communication with the crankcase chamber, and at least one cylinder associated with the crankcase;

a second unit comprising a second unit case defining a second unit case chamber therein, distinct from the crankcase chamber, a second unit suction port in fluid communication with the second unit case chamber; and a lubrication system for providing an oil supply for use in the internal combustion engine and the second unit, the lubrication system including a lubrication tank, a lubricant supply for supplying lubricant from the lubrication tank to at least one of the crankcase chamber and the second unit case chamber, a lubricant return for returning lubricant to the lubrication tank, and a first pump having an inlet in fluid communication with the second unit suction port and an outlet in fluid communication to the lubricant return, whereby operation of the first pump withdraws lubricant via the second unit suction port and returns lubricant to the lubrication tank, the crankcase being in fluid communication with the second unit case chamber, and wherein operation of the first pump withdraws lubricant via the crankcase suction port and delivers lubricant to the second unit case chamber and withdraws lubricant via the second unit suction port and returns lubricant to the lubrication tank.

2. The power unit according to claim 1, wherein the second unit is a transmission for transmitting power from the internal engine to drive a vehicle.

3. The power unit according to claim 1, wherein a plurality of transmission gears are located within the second unit case.

4. The power unit according to claim 1, wherein the second unit is a clutch for coupling and decoupling the internal combustion engine to/from another component in a vehicle drive system.

5. The power unit according to claim 1, wherein the second unit includes a valve system for operating intake and exhaust valves of the internal combustion engine.

6. The power unit according to claim 1, further comprising a power unit case, the power unit case having a crankcase portion forming at least a portion of the crankcase and a second unit portion forming at least a portion of the second unit, and wherein the crankcase portion and the second unit portion are integrally formed.

7. The power unit according to claim 1, wherein the lubricant system includes a third pump having an inlet in fluid communication with the lubricant tank and a outlet in fluid communication with the lubricant supply.

8. The power unit according to claim 1, further comprising a third unit comprising a third unit case defining a third unit case chamber therein, distinct from the crankcase chamber and the second unit case chamber and in fluid communication with each, a third unit suction port in fluid communication with the third unit case chamber; and wherein the operation of the first pump withdraws lubricant via the crankcase suction port and delivers lubricant to the third unit case chamber and withdraws lubricant via the third unit suction port delivers lubricant to the second unit case chamber and withdraws lubricant via the second unit suction port and returns lubricant to the lubrication tank.

9. The power unit according to claim 8, wherein the third unit case chamber is a transmission chamber, the transmission chamber housing a transmission for transmitting power from the internal engine to drive a vehicle.

10. The power unit according to claim 9, wherein the transmission includes a plurality of transmission gears.

11. The power unit according to claim 9, wherein the second unit case chamber is a clutch chamber housing a clutch for coupling and decoupling the internal combustion engine to/from another component in a vehicle drive system.

12. The power unit according to claim 8, the second unit further comprising a second unit supply port in fluid communication with the second unit case chamber, the first pump delivering lubricant to the second unit case chamber via the second unit supply port and the second unit supply port being disposed in a position above the crankcase suction port.

13. The power unit according to claim 1, further comprising a third unit comprising a third unit case defining a third unit case chamber therein, distinct from the crankcase chamber and the second unit case chamber and in fluid communication with the second unit case chamber, a third unit suction port in fluid communication with the third unit case chamber; and wherein the operation of the first pump withdraws lubricant via the third unit suction port and delivers lubricant to the second unit case chamber and withdraws lubricant via the second unit suction port and returns lubricant to the lubrication tank.

14. The power unit according to claim 1, further comprising a third unit comprising a third unit case defining a third unit case chamber therein, distinct from the crankcase chamber and the second unit case chamber and in fluid communication with the second unit case chamber, a third unit suction port in fluid communication with the third unit case chamber; and wherein the outlet of the first pump is in fluid communication with the lubricant return via the third unit case chamber.

15. The power unit according to claim 1, further comprising;

a third unit comprising a third unit case defining a third unit case chamber therein, distinct from the crankcase chamber and the second unit case chamber and in fluid communication with the second unit case chamber, a third unit suction port in fluid communication with the third unit case chamber, wherein the crankcase chamber is in fluid communication with the second unit case chamber, and wherein the operation of the first pump also withdraws lubricant via the third unit suction port and delivers lubricant to the second unit case chamber and withdraws lubricant via the crankcase suction port and delivers lubricant to the second unit case chamber.

16. The power unit according to claim 1, wherein the lubrication system is a dry sump lubrication system, the lubrication tank being disposed outside of the crankcase chamber.

17. The power unit according to claim 1, wherein the power unit is applied to power at least one of a snowmobile, personal watercraft, motorcycle, three-wheeled vehicle, go-kart, all terrain vehicle and a scooter.

18. The power unit according to claim 17, wherein the internal combustion engine has at least two cylinders.

19. The power unit according to claim 18, wherein the at least two cylinders are arranged in a V-type cylinder configuration.

20. The power unit according to claim 1, wherein a first conduit is provided, the conduit connecting the crankcase chamber with the second unit case chamber, the conduit being used for the withdrawal of lubricant from the crankcase suction port and for the deliverance of lubricant to the second unit case chamber by the first pump, the conduit allowing for a permanent fluid communication between the crankcase chamber and the second unit case chamber.

21. The power unit according to claim 1, the second unit further comprising a second unit supply port in fluid communication with the second unit case chamber, the first pump delivering lubricant to the second unit case chamber via the second unit supply port and the second unit supply port being disposed in a position above the crankcase suction port.

22. A power unit, comprising:

an internal combustion engine comprising a crankcase defining a chamber therein, a crankcase suction port in fluid communication with the crankcase chamber, and at least one cylinder associated with the crankcase;

a second unit comprising a second unit case defining a second unit case chamber therein, distinct from the crankcase chamber, a second unit suction port in fluid communication with the second unit case chamber;

a lubrication system for providing an oil supply for use in the internal combustion engine and the second unit, the lubrication system including a lubrication tank, a lubricant supply for supplying lubricant from the lubrication tank to at least one of the crankcase chamber and the second unit case chamber, the crankcase chamber being in fluid communication with the second unit case chamber, a lubricant return for returning lubricant to the lubrication tank, and a first pump having an inlet in fluid communication with the second unit suction port and an outlet in fluid communication to the lubricant return, the operation of the first pump withdrawing lubricant via the second unit suction port and returns lubricant to the lubrication tank; and a second pump having an inlet in fluid communication with the crankcase suction port and an outlet in fluid communication with the second unit case chamber, whereby operation of the second pump withdraws lubricant via the crankcase suction port and delivers lubricant to the second unit case chamber.

23. A power unit, comprising:

an internal combustion engine comprising a crankcase defining a chamber therein, a crankcase suction Port in fluid communication with the crankcase chamber, and at least one cylinder associated with the crankcase;

a second unit comprising a second unit case defining a second unit case chamber therein, distinct from the crankcase chamber, a second unit suction port in fluid communication with the second unit case chamber;

a lubrication system for providing an oil supply for use in the internal combustion engine and the second unit, the lubrication system including a lubrication tank, a lubricant supply for supplying lubricant from the lubrication tank to at least one of the crankcase chamber and the second unit case chamber, a lubricant return for returning lubricant to the lubrication tank, and a first pump having an inlet in fluid communication with the second unit suction port and an outlet in fluid communication to the lubricant return, whereby operation of the first pump withdraws lubricant via the second unit suction port and returns lubricant to the lubrication tank; and a second pump having an inlet in fluid communication with the crankcase suction port and an outlet in fluid communication with the lubricant return, the operation of the second pump withdraws lubricant from the crankcase suction port and returning lubricant to the lubrication tank.

24. The power unit according to claim 23, further comprising;

a third unit comprising a third unit case defining a third unit case chamber therein, distinct from the crankcase chamber and the second unit case chamber, a third unit suction port in fluid communication with the third unit case chamber; and a third pump having an inlet in fluid communication with the third unit suction port and an outlet in fluid communication with the lubricant return, whereby operation of the third pump withdraws lubricant from the third suction port and returns lubricant to the lubrication tank.

25. The power unit according to claim 23, wherein the second unit is a transmission for transmitting power from the internal engine to drive a vehicle.

26. The power unit according to claim 23, wherein a plurality of transmission gears are located within the second unit case.

27. The power unit according to claim 23, wherein the second unit is a clutch for coupling and decoupling the internal combustion engine to/from another component in a vehicle drive system.

28. The power unit according to claim 23, wherein the second unit includes a valve system for operating intake and exhaust valves of the internal combustion engine.

29. The power unit according to claim 23, further comprising a power unit case, the power unit case having a crankcase portion forming at least a portion of the crankcase and a second unit portion forming at least a portion of the second unit, and wherein the crankcase portion and the second unit portion are integrally formed.

30. The power unit according to claim 23, wherein the lubricant system includes a third pump having an inlet in fluid communication with the lubricant tank and a outlet in fluid communication with the lubricant supply.

31. The power unit according to claim 23, wherein the lubrication system is a dry sump lubrication system, the lubrication tank being disposed outside of the crankcase chamber.

32. The power unit according to claim 23, wherein the power unit is applied to power at least one of a snowmobile, personal watercraft, motorcycle, three-wheeled vehicle, go-kart, all terrain vehicle and a scooter.

33. The power unit according to claim 32, wherein the internal combustion engine has at least two cylinders.

34. The power unit according to claim 33, wherein the at least two cylinders are arranged in a V-type cylinder configuration.

35. The power unit according to claim 23, wherein a first conduit is provided, the conduit connecting the crankcase chamber with the second unit case chamber, the conduit being used for the withdrawal of lubricant from the crankcase suction port and for the deliverance of lubricant to the second unit case chamber by the first pump, the conduit allowing for a permanent fluid communication between the crankcase chamber and the second unit case chamber.

36. A power unit, comprising:

an internal combustion engine comprising a crankcase defining a chamber therein, a crankcase suction port in fluid communication with the crankcase chamber, and at least one cylinder associated with the crankcase;

a second unit comprising a second unit case defining a second unit case chamber therein, distinct from the crankcase chamber, a second unit suction port in fluid communication with the second unit case chamber; and a lubrication system for providing an oil supply for use in the internal combustion engine and the second unit, the lubrication system including a lubrication tank, a lubricant supply for supplying lubricant from the lubrication tank to at least one of the crankcase chamber and the second unit case chamber, a lubricant return for returning lubricant to the lubrication tank, and a first pump having an inlet in fluid communication with the second unit suction port and an outlet in fluid communication to the lubricant return, whereby operation of the first pump withdraws lubricant via the second unit suction port and returns lubricant to the lubrication tank, the inlet of the first pump being also in fluid communication with the crankcase chamber suction port, wherein the power unit further comprises a power unit case, the power unit case having a crankcase portion forming at least a portion of the crankcase and a second unit portion forming at least a portion of the second unit, and wherein the crankcase portion and the second unit portion are integrally formed.

37. A power unit, comprising:

an internal combustion engine comprising a crankcase defining a chamber therein, a crankcase suction port in fluid communication with the crankcase chamber, and at least one cylinder associated with the crankcase;

a second unit comprising a second unit case defining a second unit case chamber therein, distinct from the crankcase chamber, a second unit suction port in fluid communication with the second unit case chamber; and a lubrication system for providing an oil supply for use in the internal combustion engine and the second unit, the lubrication system including a lubrication tank, a lubricant supply for supplying lubricant from the lubrication tank to at least one of the crankcase chamber and the second unit case chamber, a lubricant return for returning lubricant to the lubrication tank, and a first pump having an inlet in fluid communication with the second unit suction port and an outlet in fluid communication to the lubricant return, whereby operation of the first pump withdraws lubricant via the second unit suction port and returns lubricant to the lubrication tank, the crankcase being in fluid communication with the second unit case chamber, and the first pump returning lubricant to the lubricant tank via the crankcase chamber.

38. The power unit according to claim 37, wherein the outlet of the first pump is in fluid communication with the lubricant return via the crankcase chamber.

39. The power unit according to claim 38, further comprising a second pump having an inlet in fluid communication with the crankcase suction port and an outlet in fluid communication with the lubricant return, whereby operation of the second pump withdraws lubricant via the crankcase suction port and delivers lubricant to the lubricant return.

40. The power unit according to claim 37, wherein the inlet of the first pump is in fluid communication with the second unit suction port via the crankcase chamber.

41. The power unit according to claim 37, wherein the second unit is a transmission for transmitting power from the internal engine to drive a vehicle.

42. The power unit according to claim 37, wherein a plurality of transmission gears are located within the second unit case.

43. The power unit according to claim 37, wherein the second unit is a clutch for coupling and decoupling the internal combustion engine to/from from another component in a vehicle drive system.

44. The power unit according to claim 37, wherein the second unit includes a valve system for operating intake and exhaust valves of the internal combustion engine.

45. The power unit according to claim 37, further comprising a power unit case, the power unit case having a crankcase portion forming at least a portion of the crankcase and a second unit portion forming at least a portion of the second unit, and wherein the crankcase portion and the second unit portion are integrally formed.

46. The power unit according to claim 37, wherein the lubricant system includes a third pump having an inlet in fluid communication with the lubricant tank and a outlet in fluid communication with the lubricant supply.

47. The power unit according to claim 37, wherein the lubrication system is a dry sump lubrication system, the lubrication tank being disposed outside of the crankcase chamber.

48. The power unit according to claim 37, wherein the power unit is applied to power at least one of a snowmobile, personal watercraft, motorcycle, three-wheeled vehicle, go-kart, all terrain vehicle and a scooter.

49. The power unit according to claim 48, wherein the internal combustion engine has at least two cylinders.

50. The power unit according to claim 49, wherein the at least two cylinders are arranged in a V-type cylinder configuration.

51. The power unit according to claim 37, wherein a first conduit is provided, the conduit connecting the crankcase chamber with the second unit case chamber, the conduit being used for the withdrawal of lubricant from the crankcase suction port and for the deliverance of lubricant to the second unit case chamber by the first pump, the conduit allowing for a permanent fluid communication between the crankcase chamber and the second unit case chamber.

* * * * *